US005516981A

United States Patent [19]

Nagai

[11] Patent Number: 5,516,981

[45] Date of Patent: May 14, 1996

[54] MUSICAL INSTRUMENT TUNED IN NINETEEN NOTE TEMPERAMENT SCALE

[75] Inventor: Youhei Nagai, Shizuoka, Japan

[73] Assignee: Yamaha Corporation, Japan

[21] Appl. No.: 269,656

[22] Filed: Jun. 30, 1994

[30] Foreign Application Priority Data

Jul. 1, 1993 [JP] Japan ..... 5-163585
Jul. 1, 1993 [JP] Japan ..... 5-163586

[51] Int. Cl.[6] ..... G10C 3/12; G10H 1/057; G10H 1/18

[52] U.S. Cl. ..... 84/615; 84/627; 84/653; 84/663; 84/451

[58] Field of Search ..... 84/615–620, 653–658, 84/678–690, 742, 451, 627, 663

[56] References Cited

U.S. PATENT DOCUMENTS 4,480,519 11/1984 Allen ..... 84/451 X
5,306,865 4/1994 Dinnan et al. ..... 84/451 X

*Primary Examiner*—Stanley J. Witkowski
*Attorney, Agent, or Firm*—Ostrolenk, Faber, Gerb & Soffen

[57] ABSTRACT

A musical instrument produces nineteen tones in each octave, and the nineteen tones have respective fundamental frequencies regulated to a geometrical series of $\sqrt[19]{2}$ so as to be highly harmonized without difficult in performance.

3 Claims, 17 Drawing Sheets

| INTERVAL | APPROXIMATE INTEGRAL RATIO | OFFSET (CENT) | CONSONANCE |
|---|---|---|---|
| 1 | 18/17 | 1 | |
| 2 | 9/8 | 5 | 1 |
| 3 (MINOR THIRD) | 6/5 | 15 | 4 |
| 4 (MAJOR THIRD) | 5/4 | 14 | 4 |
| 5 (FOURTH) | 4/3 | 2 | 6 |
| 6 | 17/12 | 5 | 1 |
| 7 (FIFTH) | 3/2 | 2 | 6 |
| 8 (MINOR SIXTH) | 8/5 | 14 | 4 |
| 9 (MAJOR SIXTH) | 5/3 | 15 | 4 |
| 10 | 16/9 | 5 | 1 |
| 11 | 17/9 | 1 | |

Fig. 1
PRIOR ART

| WT | 5 | 4 | 3 | | | | | | 2 | | 1 | | | | | | | |
|---|---|---|---|---|---|---|---|---|---|---|---|---|---|---|---|---|---|---|
| FR / NT | 3/2 | 4/3 | 5/3 | 5/4 | 7/4 | 6/5 | 7/5 | 8/5 | 9/5 | 7/6 | 11/6 | 8/7 | 9/7 | 10/7 | 11/7 | 12/7 | 13/7 | SR |
| 12 | 4 | 4 | 1 | 1 | | 1 | | 1 | | | | | | | | | | 48 |
| 13 | | | | 1 | | | | 1 | 4 | 1 | | | | | | 1 | | 17 |
| 14 | 1 | 1 | | | | | | | 1 | 1 | | | 2 | | 1 | 1 | | 17 |
| 15 | | | 3 | 1 | 1 | 3 | | 1 | | | 1 | 1 | | | | | | 29 |
| 16 | | | 1 | 1 | 2 | 1 | | 1 | | | 5 | 2 | 1 | | | | | 26 |
| 17 | 3 | 3 | | | | | | | | 1 | 1 | | 1 | | 2 | 1 | 1 | 35 |
| 18 | | | | 1 | | | | 1 | | 5 | | | | | | 5 | 3 | 24 |
| 19 | 2 | 2 | 5 | 2 | | 5 | 1 | 2 | 2 | 1 | | | 2 | 1 | | 1 | 4 | 77 |
| 20 | | | 1 | | 1 | 1 | | | 4 | | | 1 | 1 | | 4 | | 2 | 25 |
| 21 | 1 | 1 | | 1 | 4 | | 1 | 1 | 1 | | | 4 | | 1 | | | 1 | 38 |
| 22 | 2 | 2 | 1 | 3 | 1 | 1 | | 3 | | 2 | 1 | 1 | 5 | | | 2 | | 58 |
| 23 | | | 4 | | | 4 | 2 | | | 2 | 2 | | | 2 | 5 | 2 | | 45 |
| 24 | 4 | 4 | 1 | 1 | | 1 | | 1 | | 1 | 5 | | 1 | | | 1 | | 57 |
| 25 | | | | 4 | 1 | | 2 | 4 | 1 | | 2 | 1 | 4 | 2 | 1 | | 1 | 46 |
| 26 | 1 | 1 | 2 | 1 | 5 | 2 | | 1 | 4 | 1 | 1 | 5 | | | 4 | 1 | 1 | 64 |
| 27 | 1 | 1 | 3 | 1 | 1 | 3 | 3 | 1 | 3 | 5 | | 1 | 1 | 3 | | 5 | 3 | 74 |
| 28 | 1 | 1 | 1 | 5 | 1 | 1 | | 5 | 1 | 1 | | 1 | 2 | | 1 | 1 | 5 | 62 |
| 29 | 5 | 5 | 1 | 1 | 1 | 1 | 4 | 1 | 1 | | 1 | 1 | | 4 | 3 | | 3 | 36 |
| 30 | | | 3 | 1 | 1 | 3 | | 1 | | 1 | 1 | 1 | 3 | | | 1 | 2 | 37 |
| 31 | 3 | 3 | 2 | 5 | 5 | 2 | 4 | 5 | 1 | 3 | 3 | 5 | 1 | 4 | 2 | 3 | 1 | 123 |

Fig. 3

| INTERVAL | APPROXIMATE INTEGRAL RATIO | OFFSET (CENT) | CONSONANCE |
|---|---|---|---|
| 1(SECOND) | 28/27 | 0.3 | |
| 2 | 14/13 | 3 | |
| 3 | 10/9 | 7 | 1 |
| 4 | 7/6 | 13 | 2 |
| 5 | 6/5 | 0.1 | 6 |
| 6 | 5/4 | 7 | 4 |
| 7 | 9/7 | 7 | 2 |
| 8 | 4/3 | 7 | 5 |
| 9 | 7/5 | 13 | 3 |
| 10 | 10/7 | 13 | 3 |
| 11 | 3/2 | 7 | 5 |
| 12 | 14/9 | 7 | 2 |
| 13 | 8/5 | 7 | 4 |
| 14 | 5/3 | 0.1 | 6 |
| 15 | 12/7 | 13 | 2 |
| 16 | 16/9 | 13 | 1 |
| 17 | 13/7 | 3 | |
| 18 | 27/14 | 0.3 | |

Fig. 4

| | INTERVAL BETWEEN NOTES | NOTES | | NAME |
|---|---|---|---|---|
| | | ASSUME TONIC TO BE "1" | ASSUME TONIC TO BE "C" | |
| TRIAD | 3 3 6 | 1, 4, 7, 13 | C, #D, #F | -5 |
| | 3 6 3 | 1, 4, 10, 13 | C, #D, A | Adim. |
| | 6 3 3 | 1, 7, 10, 13 | C, #F, A | #Fdim. |
| | 3 4 5 | 1, 4, 8, 13 | C, #D, G | m. |
| | 3 5 4 | 1, 4, 9, 13 | C, #D, #G | #Gmaj. |
| | 4 3 5 | 1, 5, 8, 13 | C, E, G | Major |
| | 4 5 3 | 1, 5, 10, 13 | C, E, A | Am |
| | 5 3 4 | 1, 6, 9, 13 | C, F, #G | Fmin. |
| | 5 4 3 | 1, 6, 10, 13 | C, F, A | F |
| | 4 4 4 | 1, 5, 9, 13 | C, E, #G | aug. |
| TETRAD | 3 3 3 3 | 1, 4, 7, 10, 13 | C, #D, #F, A | dim. |
| | 2 3 3 4 | 1, 3, 6, 9, 13 | C, D, F, #G | Fm. 6th |
| | 2 3 4 3 | 1, 3, 6, 10, 13 | C, D, F, A | F6th |
| | 2 4 3 3 | 1, 3, 7, 10, 13 | C, D, #F, A | D7th |
| | 3 2 3 4 | 1, 4, 6, 9, 13 | C, #D, F, #G | Fm. 7th |
| | 3 2 4 3 | 1, 4, 6, 10, 13 | C, #D, F, A | F7th |
| | 3 3 2 4 | 1, 4, 7, 9, 13 | C, #D, #F, #G | #G6th |
| | 3 3 4 2 | 1, 4, 7, 11, 13 | C, #D, #F, #A | m7-5 |
| | 3 4 2 3 | 1, 4, 8, 10 | C, #D, G, A | m. 6th |
| | 3 4 3 2 | 1, 4, 8, 11 | C, #D, G, #A | m. 7th |
| | 4 2 3 3 | 1, 5, 7, 10, 13 | C, E, #F, A | Am. 7th |
| | 4 3 2 3 | 1, 5, 8, 10, 13 | C, E, G, A | 6th |
| | 4 3 3 2 | 1, 5, 8, 11, 13 | C, E, G, A# | 7th |
| | 4 4 2 2 | 1, 5, 9, 11, 13 | C, E, #G, #A | aug. 7 |
| | 2244, 2424<br>2442, 4224<br>4242 | | | |
| TOTAL : | 29CHORDS | | | |

Fig. 5A

| | INTERVAL BETWEEN NOTES | CHORD NAME CORRESPONDING TO THOSE OF TWELEVE NOTES TEMPERAMENT SCALE |
|---|---|---|
| TRIAD | 3 7 9 | — |
| | 4 6 9 | — |
| | 4 7 8 | — |
| | 5 6 8 | Major, minor |
| | 6 FROM EACH: TOTAL 24 | |
| | 3 8 8 | sus4 |
| | 5 7 7 | — |
| | 6 6 7 | aug |
| | 3 FROM EACH: TOTAL 9 | |
| | TOTAL : 33 | |
| TETRAD | 3 4 5 7 | — |
| | TOTAL : 24 | — |
| | | — |
| | 3 3 4 9 | — |
| | 3 3 5 8 | 7sus4 |
| | 3 3 6 7 | — |
| | 3 4 4 8 | — |
| | 3 4 6 6 | aug7, 7-5 |
| | 3 5 5 6 | 7th, m7th, 6th, m6th, m7-5 |
| | 4 4 5 6 | — |
| | 12 FROM EACH: TOTAL 84 | |
| | 4 4 4 7 | — |
| | 4 5 5 5 | dim. |
| | 4 FROM EACH: TOTAL 8 | |
| | TOTAL 116 | |
| TOTAL : 149 | | |

Fig. 5B

| MANIPULATED PISTON MEMER | PITCH NAME | | | |
|---|---|---|---|---|
| NONE | 1 | 12 | $\dot{1}$ | $\dot{5}$ |
| 33a (LOWERED BYP) | $1_{\cdot}9$ | 11 | 19 | $\dot{4}$ |
| 33b (LOWERED BY 2P) | $1_{\cdot}8$ | 10 | 18 | $\dot{3}$ |
| 33a& 33b (LOWERED BY 3P) | $1_{\cdot}7$ | 9 | 17 | $\dot{2}$ |
| 33c (LOWERED BY 4P) | $1_{\cdot}6$ | 8 | 16 | ($\dot{1}$) |
| 33a& 33c (LOWERED BY 5P) | $1_{\cdot}5$ | 7 | 15 | |
| 33b&33c (LOWERED BY 6P) | $1_{\cdot}4$ | 6 | 14 | |
| 33a,33b & 33c (LOWERED BY 7P) | $1_{\cdot}3$ | 5 | 13 | |
| 33d (LOWERED BY 8P) | $1_{\cdot}2$ | 4 | (12) | |
| 33a & 33d (LOWERED BY 9P) | $1_{\cdot}1$ | 3 | (11) | |
| 33b & 33d (LOWERED BY 10P) | $1_{\cdot}0$ | 2 | (10) | |

Fig·11

MUSICAL INSTRUMENT TUNED IN NINETEEN NOTE TEMPERAMENT SCALE

FIELD OF THE INVENTION

This invention relates to a musical instrument and, more particularly, to a musical instrument for producing nineteen notes in each octave.

DESCRIPTION OF THE RELATED ART

Various musical instruments have been fabricated for music, and are largely broken down into a keyboard instrument, a wind instrument, a stringed instrument and a percussion instrument. Although a musical instrument belongs to any category, the musical instrument is tuned in accordance with a scale, and the twelve-note temperament scale is the most popular. In the twelve-note temperament scale, each octave contains 12 notes, and every two adjacent notes have a frequency ratio at $\sqrt[12]{2}$.

FIG. 1 shows relation between the notes of the temperament, and the interval represents an internal between two notes forming in combination a chord using the seminotes. The frequency ratio between the two notes is approximated, and the approximate integral ratios are listed in the second column. The offset is a difference between an actual frequency and the approximated frequency, and the unit of the difference is cent. In the twelve-note temperament, the simpler the frequency ratio is, the higher the consonance is.

Prior art keyboard instruments have the keyboards arranged in the twelve note temperament scale, and the arrangement of the typical keyboard is illustrated in FIG. 2. The prior art keyboard has seven white keys WT1, WT2, WT3, WT4, WT5, WT6 and WT7 and five black keys BK1, BK2, BK3, BK4 and BK5, and note C, C#, D, D#, E, F, F#, G, G#, A, A#and B are assigned to the white and block keys WT1 to WT7 and BK1 to BK5, respectively. Every two adjacent keys respectively produce sounds with respective fundamental frequencies regulated to a ratio of $\sqrt[12]{2}$.

If the interval is the perfect fourth or the perfect fifth, the two notes are in perfect consonance, and the consonance is the highest of all. A listener feels the perfect consonance comfortable, and a composer usually takes the perfect consonance into account.

The twelve note temperament scale gives fairly good consonance to the minor third, the major third, the minor sixth and the major sixth as will be understood from FIG. 1. However, the offset of the 14 or 15 cents takes place between the actual frequency of each of these chords and the frequency given by the approximate integral ratio, and, for this reason, the chords are not perfectly clear. The prior art musical instruments arranged in the twelve note temperament scale encounter a first problem of imperfect consonance.

Moreover the minor third, the major third, the minor sixth and the major sixth set limit on associated notes constituting concords together therewith, because they are close to the frequency ratio 7/5, 9/5, 7/6 or 9/7. Therefore, another problem inherent in the prior art musical instruments is the relatively small number of conchords.

Of course, if a large number of notes constitutes a temperament scale, a composer can freely form perfect consonance. However, a musical instrument arranged in a complex scale is not practical.

SUMMARY OF THE INVENTION

It is therefore an important object of the present invention to provide a musical instrument which is free from the problem inherent in the prior art musical instruments arranged in accordance with the twelve note temperament scale.

To accomplish the object, the present invention proposes to constitute nineteen notes with respective frequencies in the geometrical series $\sqrt[19]{2}$.

In accordance with the present invention, there is provided a musical instrument comprising: a plurality of specifying means respectively assigned notes of a temperament scale, and manipulated by a player for performing a music, nineteen notes constituting each octave of said temperament scale, said nineteen notes respectively having frequencies forming a geometrical series of $\sqrt[19]{2}$; and a sound producing means responsive to the manipulation of the plurality of specifying means for producing sounds with the notes specified by said player.

The musical instrument may be a keyboard instrument, a wind instrument, a stringed instrument or a percussion instrument.

BRIEF DESCRIPTION OF THE DRAWINGS

The features and advantages of the musical instrument according to the present invention will be more clearly understood from the following description taken in conjunction with the accompanying drawings in which:

FIG. 1 is a view showing the relation between the interval, the approximate integral ratio, the offset and the consonance in the twelve note temperament scale;

FIG. 3 is a view showing various temperament scales;

FIG. 4 is a view showing the approximate integral ratio, the offset and the consonance in terms of the interval of two note in the nineteen notes temperament scale;

FIGS. 5A is a view showing the triads and the tetrads of the twelve note temperament scale;

FIG. 5B is a view showing the triads and the tetrads of the nineteen note temperament scale;

FIG. 11 is a view showing relation between the manipulated piston members of the trumpet and the notes producible under the manipulated piston members;

DESCRIPTION OF THE PREFERRED EMBODIMENT

Temperament Scale Available for Musical Instrument

Figure 2:
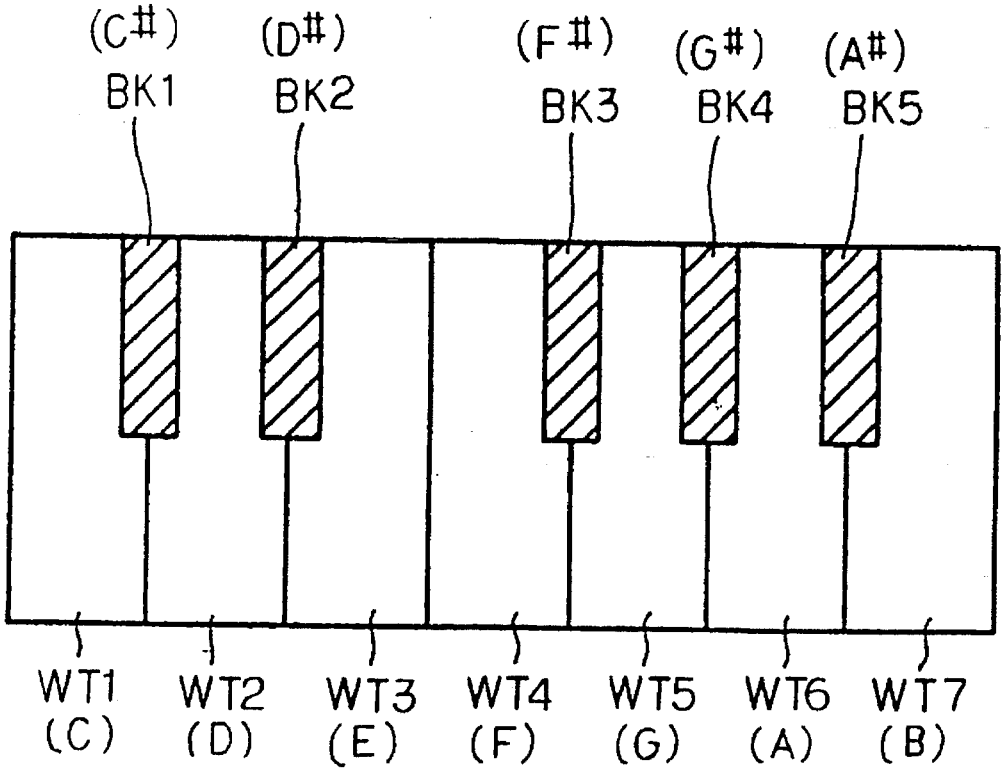
Fig.2 PRIOR ART
FIG. 2 is a plan view showing the arrangement of the prior art keyboard.

Referring to FIG. 3 of the drawings, various temperament scales are evaluated, and "frequency ratio", "the number of notes constituting a temperament scale", "weight" and "score" are abbreviated as "FR", "NT", "WT" and "SR". Numbers "5", "4", "3", "2" and "1" are indicative of the grades of the offset range. If the offset ranges from 13 cents or over, "1" is assigned to the notes. Similarly, "2", "3", "4" and "5" stand for the offset range between 7 cents and 13 cents, the offset range between 3 cents and 7 cents, the offset range between 2 cents and 3 cents and the offset range between zero to 2 cent, respectively. The weights "5" to "1" are indicative of the simplicity of the approximate integral ratio between two notes. If the approximate integral ratio between notes is simpler than the approximate integral ratio of other notes, the weight of the notes is larger than that of the other notes. The score is given as the product of the grade of offset range and the weight.

As will be understood from FIG. 3, the twelve notes temperament scale is graded "4" at the frequency ratios 3/2 and 4/3, and is further graded "1" at the frequency ratios 5/3, 5/4, 6/5 and 8/5. However, the twelve notes temperament does not allow a musical instrument to form chords at the other frequency ratios. This results in the score "48 points".

On the other hand, the thirty one notes temperament scale allows a musical instrument to form chords at all the frequency ratio, and the score is 123 points which is the highest score of the scales listed in FIG. 3. However, if the thirty one notes constitute each octave, a musical instrument requires a large number of specifying means such as keys on a keyboard, and a player feels a performance on the musical instrument difficult.

The present inventor investigated various musical instruments, and concluded that 20 notes were the maximum in each octave for allowing a player to perform a music under the instructions of the score. A player could perform a music on a musical instrument having more than the maximum number of notes. However, the above maximum number was reasonable for a standard music player.

The present inventor looks for a temperament scale with a higher score than the twelve notes temperament scale without exceeding the maximum number, and results in that the nineteen notes temperament scale is the most desirable for a musical instrument.

The nineteen notes temperament scale is much higher in score than the twelve notes temperament scale, because the nineteen notes temperament scale allows a musical instrument to form highly consonant chords rather than the twelve notes temperament scale. In the nineteen notes temperament scale, the frequencies assigned to the notes form a geometrical series $\sqrt[19]{2}$.

FIG. 4 shows the approximate integral ratio, the offset and the consonance in terms of the interval of two notes in the nineteen notes temperament scale. In the twelve notes temperament scale, the offsets are 15 cents and 14 cents at the frequency ratio 6/5 and at the frequency ratio 5/4. However, the nineteen notes temperament scale improves the consonance at the frequency ratios 6/5 and 5/4 to 0.1 cent and 7 cents. Thus, the nineteen notes temperament scale achieves better consonance, and allows a composer to form new six chords at 7/6, 9/7, 7/5, 10/7, 14/9 and 12/7. These new chords in turn constitute new triads and new tetrads. FIG. 5A shows the triads and tetrads of the twelve notes temperament scale, and the twelve notes temperament scale allows the notes to form ten triads and nineteen tetrads. On the other hand, FIG. 5B shows the triads and tetrads of the nineteen notes temperament scale, and the nineteen notes form 33 consonant triads and 116 consonant tetrads. Thus, the nineteen notes temperament scale allows 149 chords greater than 29 chords of the twelve notes temperament scale. Although the figures are silent to the pentads, the nineteen notes temperament scale forms pentads more than those of the twelve notes temperament scale.

Thus, the nineteen notes temperament scale according to the present invention is desirable for the harmony, and a player can specify the notes on a musical instrument in accordance with a score. Although the letters of the alphabet "C", "D", "E" . . . are assigned to the pitch names of the twelve notes temperament scale, numbers "1 ", "2", "3" . . . and "19" are assigned to the pitch names of the nineteen notes temperament scale in the following description.

Musical Instruments

Figure 6:
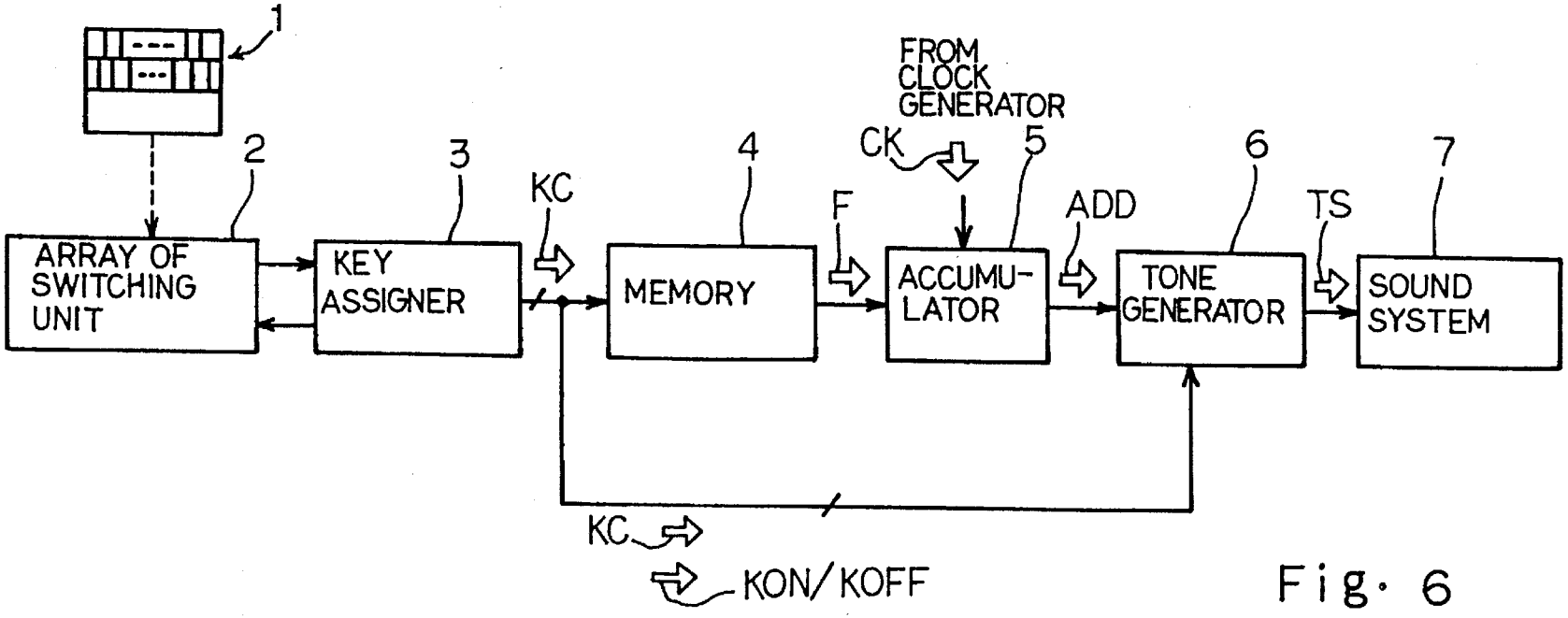
FIG. 6 is a block diagram showing the arrangement of a keyboard instrument.
Figure 7A:
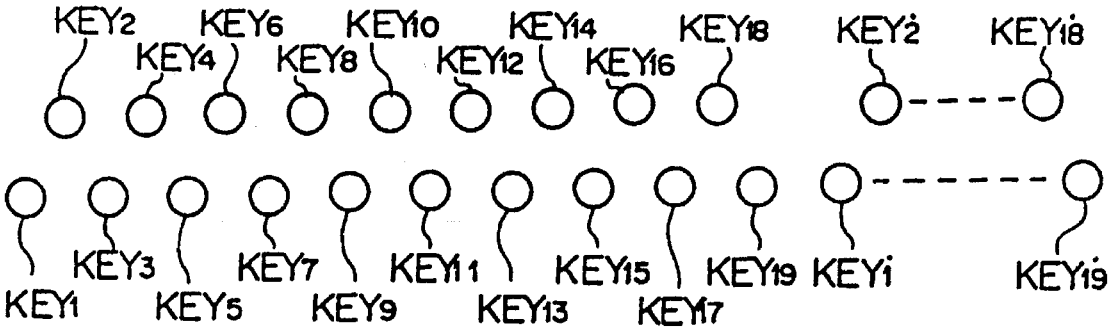
FIGS. 7A to 7C are views showing three different arrangements of keys incorporated in keyboard instruments.
Figure 7B:
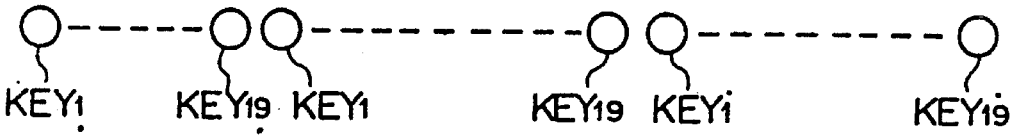
Figure 7C:
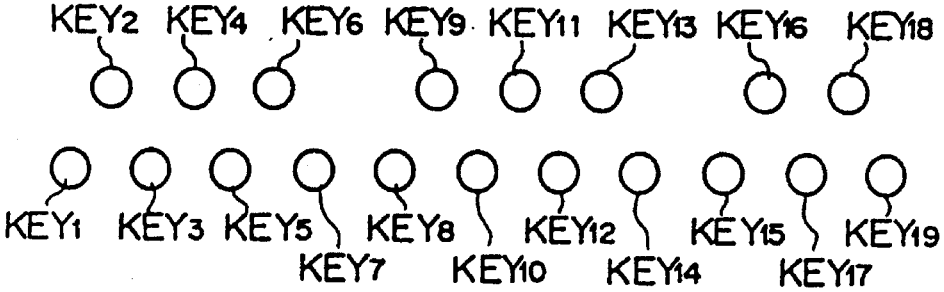

Using the nineteen notes temperament scale, various musical instruments are fabricated. FIG. 6 illustrates a keyboard instrument embodying the present invention. The keyboard instrument comprises a keyboard 1 implemented by a plurality of swingable keys KEY1, KEY2, KEY3, . . . KEY19, KEY1' . . . KEY19', . . . , and the keyboard 1 is associated with an array 2 of switching units. The switching units are respectively associated with the keys, and depressed keys make the associated switching units close. The keys are grouped by octaves, and the pitch names "1" to "19" are assigned to the nineteen keys. In this instance, the keys KEY1, . . . are arranged in two rows as shown in FIG. 7A, and the numbers after "KEY" are representative of the pitch names. The lower row is closer to a player, and the pitch or the frequency is increased from the left side to the right side. In another keyboard instrument according to the present invention, the keys may be in a straight pattern arranged as shown in FIG. 7B, and the nineteen keys of each octave may form three trapezoids as shown in FIG. 7C.

Turning back to FIG. 6 of the drawings, the keyboard instrument further comprises a key assigner 3, and the key assigner 3 periodically scans the keys to see whether or not a player depresses and releases the keys. When the key assigner 3 notices a depressed key, the key assigner 3 produces a key code signal KC indicative of the depressed key and a key-on signal KON indicative of the closed state of the associated switching unit. On the other hand, if the player releases the key, the key assigner 3 produces the key code signal KC and a key-off signal indicative of the open-state of the associated switching unit.

The keyboard instrument of FIG. 6 invention further comprises a memory 4 for storing frequency numbers F addressable with the key code signal KC and an accumulator 5 responsive to a sampling clock CK for producing a phase address data signal ADD. "19×Octaves" sets of frequency numbers F are prepared in the memory 4, and the frequency numbers for a key KEYm ($1 \leqq m < 19$) and the frequency numbers F for the key KEYm+1 are regulated in such a manner that tone signals have respective fundamental frequencies regulated to a frequency ratio of $\sqrt[19]{2}$. If the key assigner 3 supplies the key code signal KC indicative of the key KEY1, the frequency numbers F corresponding to the pitch name "1" are sequentially read out from the memory 4, and the accumulator 5 accumulates the frequency numbers F read out from the memory 4 in synchronism with the sampling clock CK for producing the phase address data signal ADD. The phase address signal ADD is indicative of a momentary phase of a tone waveform.

The keyboard instrument further comprises a tone generator 6 for producing a tone signal TS and a sound system 7 for producing a sound from the tone signal TS. Though not shown in the drawings, the tone generator 6 has a waveform memory and an envelop generator, and the phase address signal ADD specifies addresses in the waveform memory where amplitude data are stored. The amplitude data are available for forming a single period of a waveform of the tone signal. The envelop generator is responsive to the key-on signal KON and the key code signal KC for producing the tone signal TS from the amplitude data and envelop data stored therein. The tone generator 6 is responsive to the key-off signal KOFF so as to terminate the tone signal for the note identified by the key code signal KC.

The sound system 7 covers the tone signal to an analog audio signal, and generates a sound with the note specified through the depressed key. In this instance, the array of switching units 2, the key assigner 3, the memory 4, the accumulator 5, the tone generator 6 and the sound system 7 as a whole constitute an electronic sound generating system.

Assuming now that the player depresses one of the keys KEYi, the switching unit associated with the key KEYi turns on, and the key assigner 3 supplies the key code signal KC indicative of the key KEYi and the key-on signal KON. The key code signal KC causes the memory 4 to supply the key numbers corresponding to the key code KC to the accumulator 5, and the accumulator 5 accumulates the key numbers in synchronism with the sampling clock CK. The accumulator 5 produces the phase address signal ADD from the accumulated value, and the phase address signal ADD sequentially designates the addresses in the waveform memory of the tone generator 6 depending upon the accumulated value. The waveform memory of the tone generator 6 sequentially supplies the amplitude data at respective momentary phases indicated by the phase address signal ADD, and the amplitude data are sequentially multiplied by the envelop data for producing the tone signal TS. The tone signal TS thus produced is supplied to the sound system 7, and the sound system 7 generates the sound with the note specified by the depressed key KEYi.

The player concurrently depresses the keys assigned the notes of either triad or tetrad listed in FIG. 5B. The sounds concurrently generated by the sound system 7 harmonize with one another. For this reason, the player can create a harmonic progression, and listener feel the music beautiful.

Figure 8:
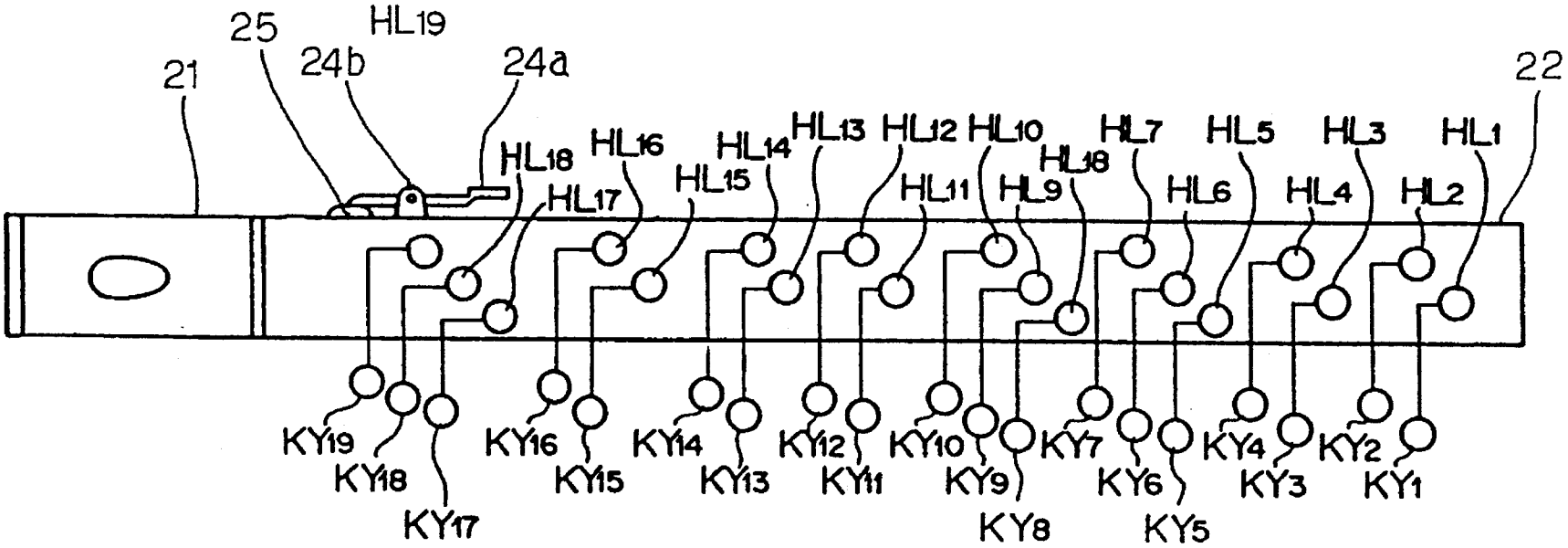
FIG. 8 is a front view showing a flute.

Turning to FIG. 8 of the drawings, a flute embodying the present invention comprises a head-joint 21 for blown by a player and a body 22 having a plurality of holes HLi where $1<i<19$. The holes HLi are located at predetermined positions in such a manner that a column of air changed by the holes HLi vibrates at respective frequencies forming a geometrical series $\sqrt[19]{2}$.

Figure 9:
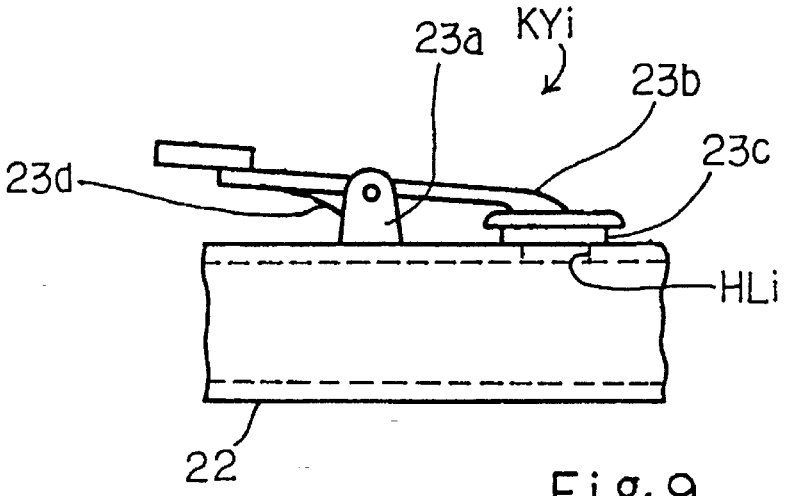
FIG. 9 is a side view showing a key mechanism incorporated in the flute shown in FIG. 7.

A plurality of key mechanisms KYi are respectively associated with the holes HLi, and each key mechanism KYi comprises a key post 23*a* fixed to the body 22, a key member 23*b* swingably supported by the key post 23*a*, a tampon 23*c* attached to the key member 23*b* for closing and opening the associated hole HLi and a spring 23*d* urging the key member 23*b* in a direction to close the hole HLi as shown in FIG. 9.

The spring 23*d* urges the key member 23*b* at all time, and the tampon 23*c* closes the hole HLi. When the player depresses the key 23*b* against the spring 23*d*, the tampon 23*c* leaves the body 22, and the hole HLi is opened. The hole HLi shortens the column of air, and the sound to be produced becomes high. For this reason, when all of the holes HL1 to HL19 are closed, the flute generates the lowest note assigned the pitch name "1". If the player opens the hole HL1, the flute generates the note with the pitch name "2". Thus, the pitch of the sound is stepwise increased by opening the holes HL1 to HL19.

The player supports the flute by the thumbs of both hands, and the keys KY1 to KY4 and the keys KY10 to KY19 are selectively manipulated by the other four fingers of the right hand and the other four fingers of the left hand. The octave key 24*a* is depressed by the thumb of the left hand. Thus, the player can manipulate the nineteen keys KY1 to KY19 as similar to a standard flute, and the sounds are beautifully harmonized.

The flute according to the present invention further comprises an octave key 24*a* swingably supported by a post 24*b* and urged to close a hole 25. The octave key 24*a* keeps the hole 25 close without manipulation by the player. If the player needs to a sound one octave higher than the sound defined by one of the holes HLi, the octave key 24*a* is manipulated by the player, and the pitch is doubled.

Figure 10:
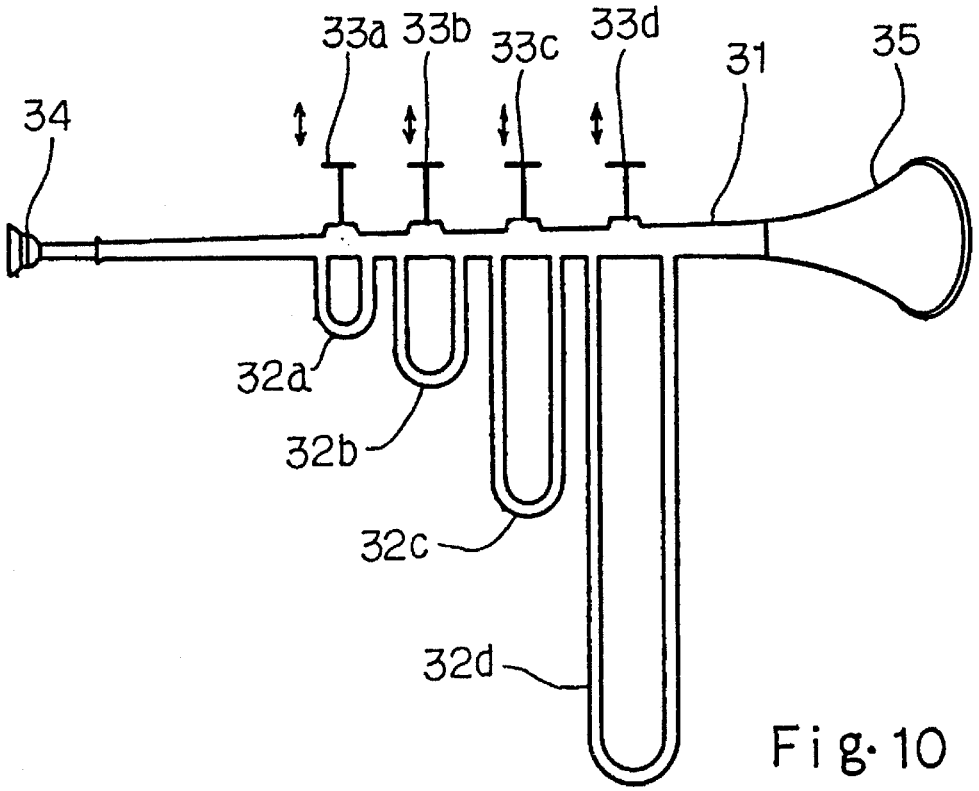
FIG. 10 is a side view showing a trumpet.

Turning to FIG. 10 of the drawings, a trumpet embodying the present invention comprises a main tube member 31, four auxiliary tube members 32*a*, 32*b*, 32*c* and 32*d*, four piston members 33*a*, 33*b*, 33*c* and 33*d* respectively associated with the four auxiliary tube members 32*a* to 32*d*, a mouth piece 34 and a bell 35. When the player manipulates the piston members 33*a* to 33*d*, the piston members 33*a* to 33*d* conduct the associated auxiliary tube members 32*a* to 32*d* to the main tube member 31, and the pitch of the sound is changed.

The main tube member 31 defines a main column of air, and the column of air is assumed to have a length "L". The auxiliary tube member adds a column of air with length of $(1\times\sqrt[19]{2})\times L$ to the main column of air, and the auxiliary tube members 32*b* to 32*d* respectively add a column of air with length of $(2\times\sqrt[19]{2})\times L$, $(4\times\sqrt[12]{2})\times L$ and $(8\times\sqrt[12]{2})\times L$ to the main column of air. In order words, the total length TL of column of air is increased to $$TL=\left(1+1\times\sqrt[19]{2}\right)L$$

$$TL=\left(1+2\times\sqrt[19]{2}\right)L$$

$$TL=\left(1+4\times\sqrt[19]{2}\right)L \text{ or}$$

$$TL=\left(1+8\times\sqrt[19]{2}\right)L$$

by selectively depressing the piston members 33*a*, 33*b*, 33*c* or 33*d*. For this reason, while the player blows into the mouth piece 34, the player manipulates or depresses one of the piston members 33*a* to 33*d* or more than one piston member, and the trumpet according to the present invention produces the nineteen notes with the frequency ratio $\sqrt[19]{2}$ each octave. FIG. 11 shows the relation between the manipulated piston members 33*a* to 33*d* and the notes producible under the manipulation, and a dot over the pitch name and a dot under the pitch name are indicative of the note one octave higher than the pitch name and the note one octave lower than the pitch name, respectively. While no piston member is being depressed, the trumpet can produce the sound with the pitch name "1", "12", "1 (with over-dot)" and "5 (with over-dot)" and these notes are i times lower in frequency than the fundamental frequency of the main air column where i is an integer. When the piston member 33*a* is depressed, the trumpet lowers the pitch by pitches A between adjacent two notes. The player selectively depresses the piston members 33*a* to 33*d* so that the trumpet lowers the pitch by 2P to 10P.

Thus, the trumpet easily is performable by the player, and creates beautiful harmony.

Figure 12:
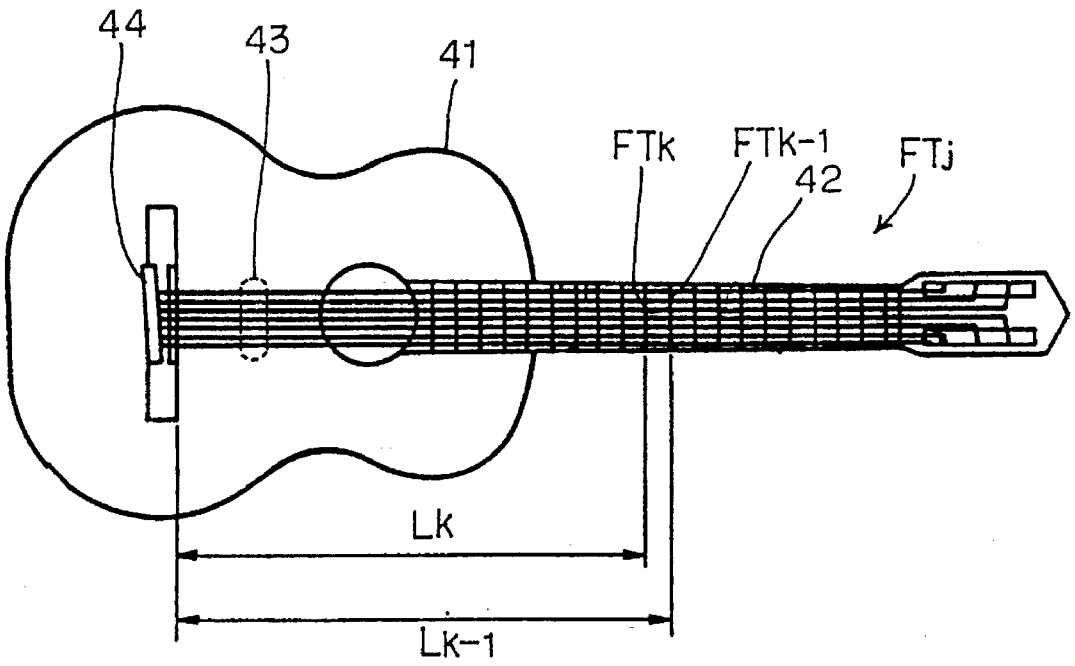
FIG. 12 is a front view showing a guitar.

Turning to FIG. 12 of the drawings, a guitar comprises a body 41 serving as a resonator, a neck 42 projecting from the body 41, seven strings 43 stretched over the body 41 and the neck 42, fret members FTj provided on the neck 42 at intervals and a bridge member 44. The notes with the pitch names "1", "6", "11", "16", "2", "7" and "12" are assigned to the seven strings 43, respectively, in open string.

The fret members FTj ($1 \leqq j \leqq 18$) are arranged as follows. The fret FTk and FTk-1 ($1<k \leqq 18$) are assumed to be spaced from the bridge member 44 by Lk and Lk-1, respectively, the ratio between the distances Lk and Lk-1 is regulated to $\sqrt[19]{2}=1.03716$. For this reason, if a player plucks one of the strings 43 under depressing the string against the fret FTk and the fret FTk-1, the string produces the sounds, and the frequency ratio therebetween is $\sqrt[19]{2}$.

In a performance, the player selectively plucks the strings 43 and depresses the strings 43 against the frets FTj. The strings 43 vibrate, and produces the nineteen notes in each octave. The fingerings are analogous to a standard guitar, and the sounds are beautifully harmonized.

Figure 13A:
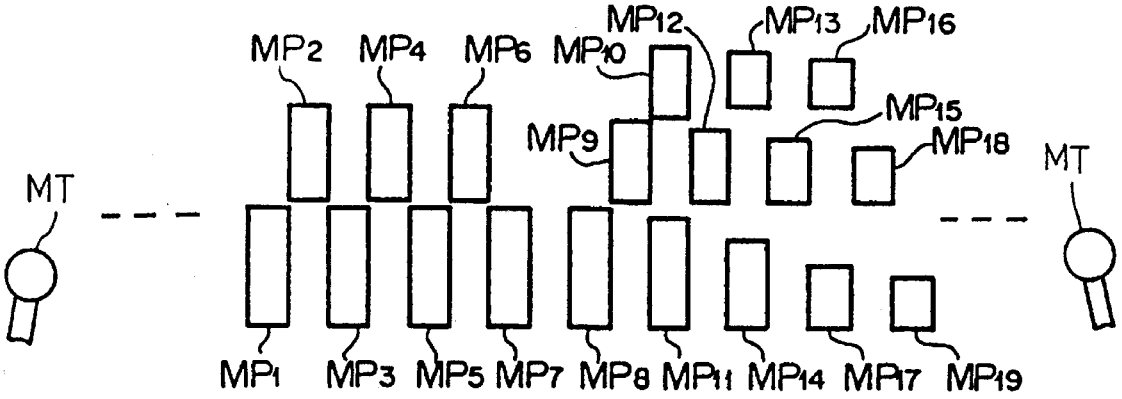
FIGS. 13A and 13B are views showing arrangements of tone bars of a xylophone or a glockenspiel.

Turning to FIG. 13A of the drawings, a percussion instrument such as, for example, a xylophone, a vibraphone or a glockenspiel comprises a plurality of tone bars MP1 to MP19 and a pair of mallets MT, and a longer tone bar MTi ($1 \leqq i \leqq$) produces a sound lower in pitch than a shorter tone bar MTi. Although the nineteen tone bars MTi are illustrated in FIG. 13A, the xylophone, the vibraphone or the glockenspiel has other tone bars on both sides of the nineteen tone bars MTi. The nineteen tone bars MTi are arranged in three rows, and every adjacent two tone bars MTi and MTi+I vibrate at respective fundamental frequencies regulated to a frequency ratio of $\sqrt[19]{2}$. The numeral after "MT" is indicative of the pitch name assigned to the tone bar MTi, and the row of tone bars MP1/MP3/MP5/MP7/MP8/MP11/MP14/ Mp17/Mp19 is closer to a player than the other rows.

Figure 13B:
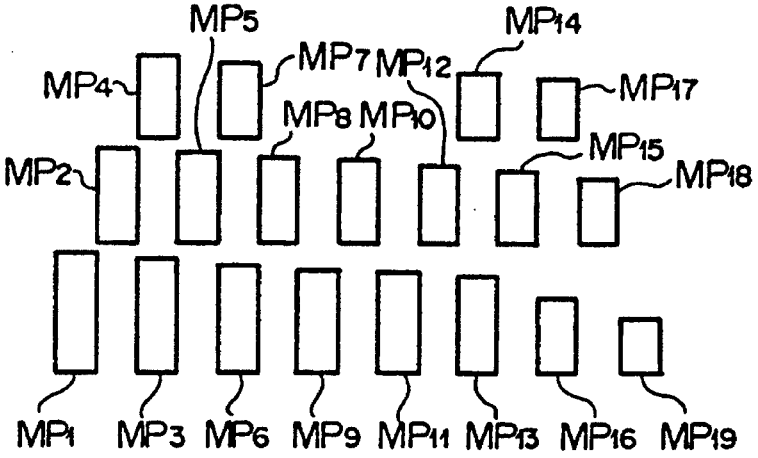

In another implementation, the tone bars MP1 to MP19 may be arranged as shown in FIG. 13B.

In a performance, the player selectively hits the tone bars MP1 to MP19 with the mallets MT, and the playing technique is analogous to a standard xylophone, a standard vibraphone or a standard glockenspiel. The tone bars MPi produce the sounds, and the sounds are well harmonized.

Arrangement of Keyboard for Keyboard instrument

Figure 14:
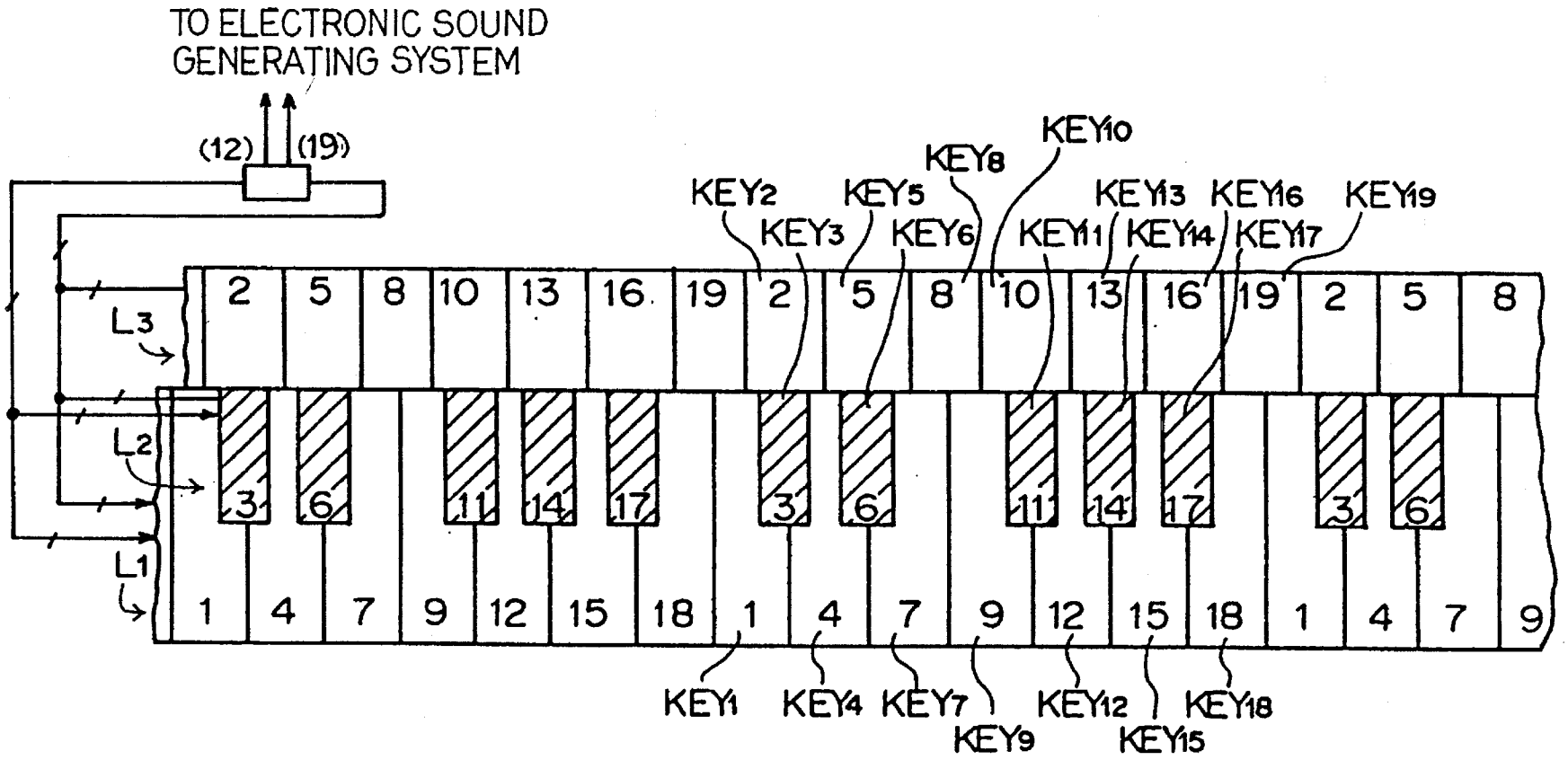
FIG. 14 is a plan view showing a keyboard incorporated in a keyboard instrument.

FIG. 14 illustrates an arrangement of a keyboard incorporated in a keyboard instrument according to the present invention. The nineteen notes "1" to "19" of the temperament scale according to the present invention are assigned to white keys KEY1, KEY2, KEY4, KEY5, KEY7, KEY8, KEY9, KEY10, KEY12, KEY13, KEY15, KEY16, KEY18 and KEY19 and black keys KEY3, KEY6, KEY11, KEY14 and KEY17. The white and black keys KEY1 to KEY19 are arranged in three rows L1, L2 and L3, and the row L1 of keys KEY1, KEY4, KEY7, KEY9, KEY12, KEY15 and KEY18 is the closest to a player of all. The rows L1 and L2 of keys KEY1/ KEY4/ KEY7/ KEY9/ KEY12/ KEY15 and KEY3/ KEY6/ KEY11/ KEY14/ KEY17 are analogous to the arrangement of the prior art keyboard shown in FIG. 2, and the white keys and the black keys are equal in width to those of the prior art keyboard. The white keys KEY2/ KEY5/ KEY8/ KEY10/ KEY13/ KEY16/ KEY19 of the third row L3 are equal in with to each of the white keys KEY1/ KEY4/ KEY7/ KEY9/ KEY12/ KEY15/ KEY18 of the first row L1, and the white keys KEY2 to KEY19 are offset toward the right side by a half width of the white key.

Although the keyboard shown in FIG. 14 is electrically connected with an electronic sound generating system through a switching unit SW. The switching unit SW is shifted to the twelve note temperament scale (12), the two rows L1 and L2 of the white and black keys are enabled for a performance. On the other hand, if the switching unit SW selects the nineteen note temperament scale (19), the three rows L1, L2 and L3 of white and black keys KEY1 to KEY19 are available for a performance.

Figure 15A:
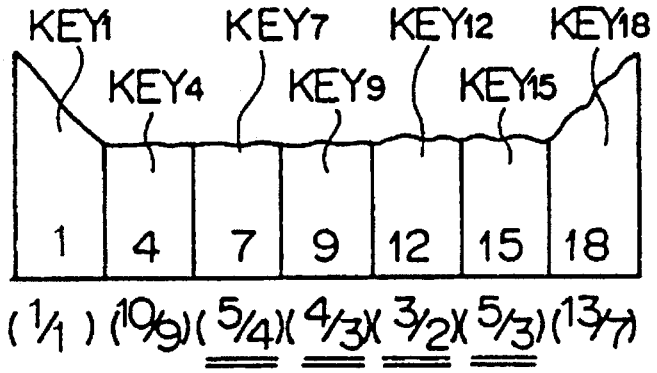
FIGS. 15A and 15B are plan views showing seven white keys switched between the twelve note temperament scale and the nineteen note temperament scale.
Figure 15B:
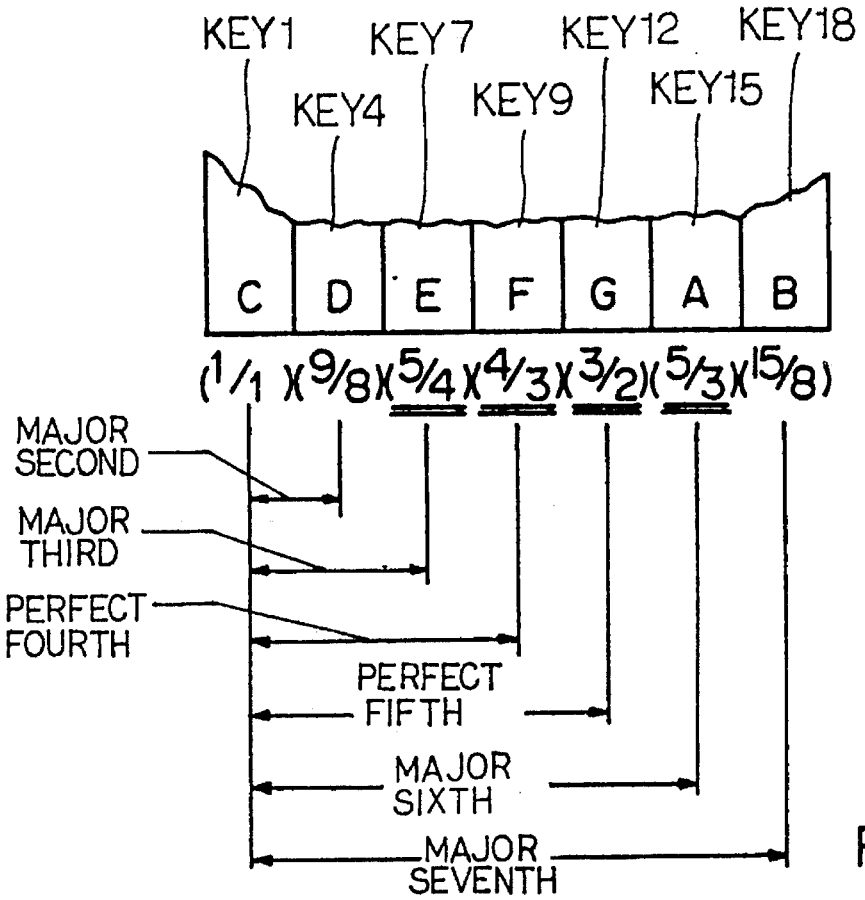

If the switching unit SW is use to select the nineteen note temperament scale, the keys KEY1, KEY4, KEY7, KEY9, KEY12, KEY15 and KEY18 are assigned the notes "1", "4", "7", "9", "12", "15" and "18", and the frequencies thereof are approximated to 1/1, 10/9, 5/4, 4/3, 3/2, 5/3 and 13/7 as shown in FIG. 15A. On the other hand, if the switching unit SW is used to select the twelve note temperament scale, the notes "C", "D", "E", "F", "G", "A" and "B" are assigned to the keys KEY1, KEY4, KEY7, KEY9, KEY12, KEY15 and KEY18, respectively, and the frequencies thereof are approximated to 1/1, 9/8, 5/4, 4/3, 3/2, 5/3 and 15/8 as shown in FIG. 15B. The intervals with respect to the note "C" are the major second, second, the major third, the perfect fourth, the perfect fifth, the major sixth and major seventh.

Comparing FIG. 15A with FIG. 15B, the frequency ratios of the keys KEY7, KEY9 and KEY12 are approximately equal between the twelve notes temperament scale and the nineteen notes temperament scale.

Figure 16:
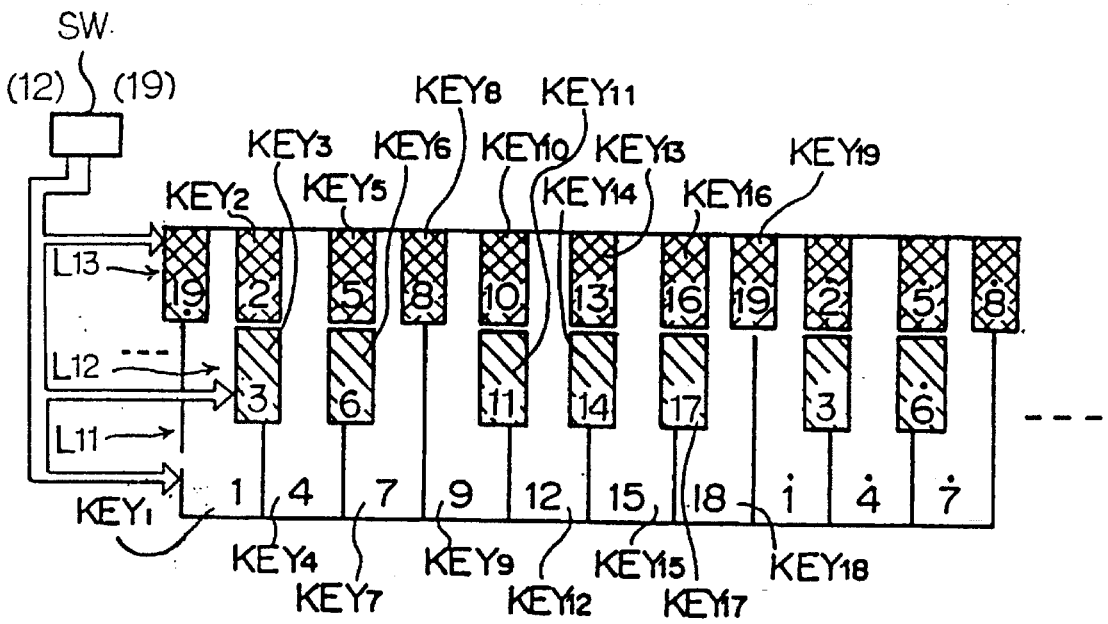
FIG. 16 is a plan view showing the arrangement of another keyboard.

FIG. 16 shows another keyboard incorporated in a keyboard instrument embodying the present invention. Each octave is constituted by nineteen notes arranged in three rows L11, L12 and L13, and the first row L11 is the closest to a player of all. White keys KEY1, KEY4, KEY7, KEY9, KEY12, KEY15 and KEY18 are assigned the notes "1", "4", "7", "9", "12", "15"and "18", and the notes "3", "6", "11", "14"and "17"are assigned to black keys KEY3, KEY6, KEY11, KEY14 and KEY17. White keys KEY2, KEY5, KEY8, KEY10, KEY13, KEY16 and KEY19 are provided for the notes "2", "5", "8", "10", "13", "16" and "19", respectively. Although the arrangement of the rows L11 and L12 is similar to those of the keyboard shown in FIG. 14, the white keys KEY2, KEY5, KEY10, KEY13 and KEY16 are aligned with the black keys KEY3, KEY6, KEY11, KEY14 and KEY17, respectively, and the white keys KEY8 and KEY19 are located between the white keys KEY7 and KEY9 and between the white keys KEY18 and KEY1 with over-dot.

A switching unit SW is also provided for the keyboard, and selectively enables the first to third rows L11, L12 and L13 as similar to the switching unit SW shown in FIG. 14.

Figure 17:
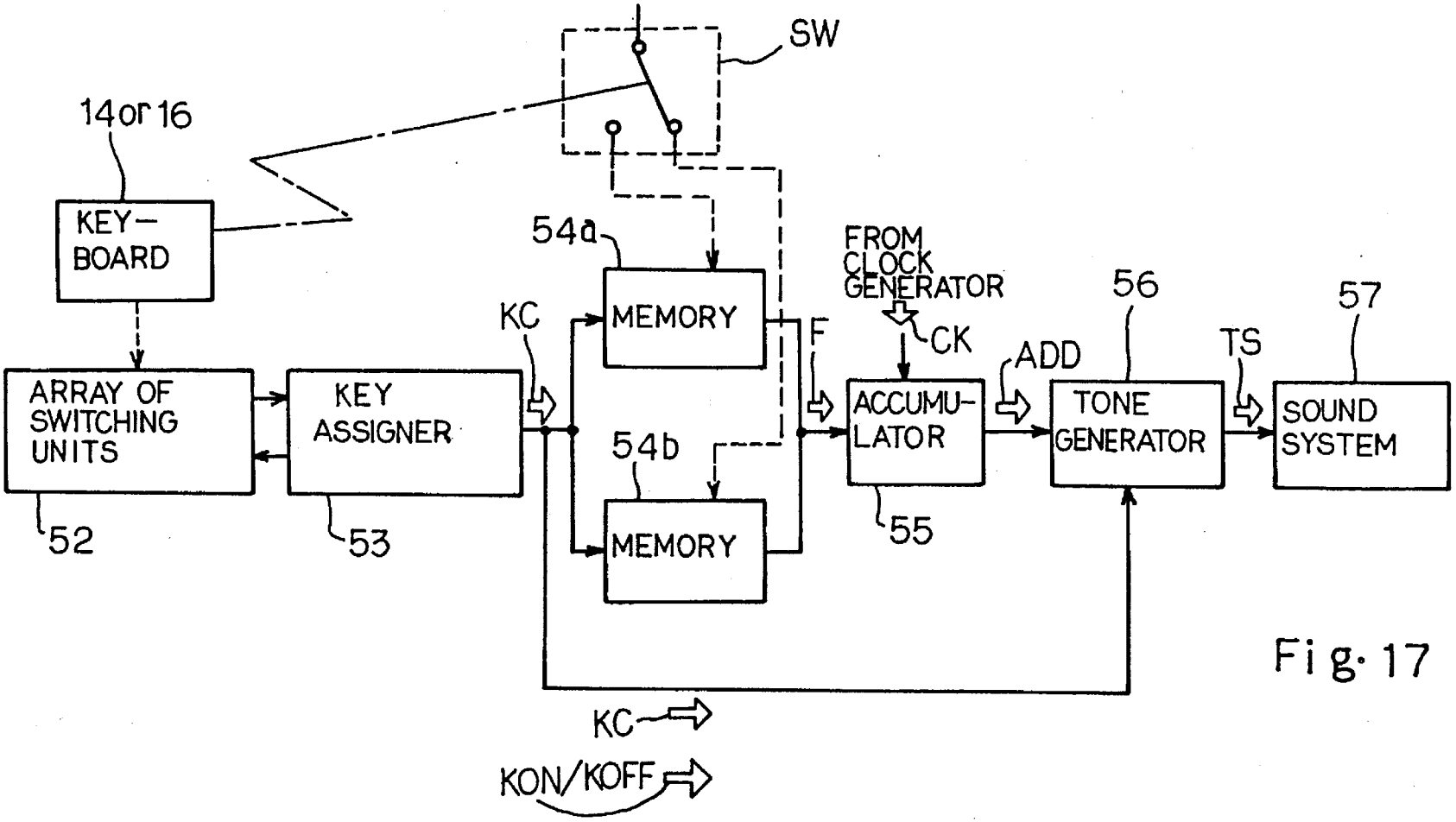
FIG. 17 is a block diagram showing the arrangement of a keyboard instrument equipped with the keyboard shown in FIG. 14 or 16.

Using the keyboard shown in either FIG. 14 or 16, a keyboard instrument according to the present invention is fabricated as shown in FIG. 17. The keyboard instrument comprises an array 52 of switching units, and the array 52 of switching units is electrically the keyboard 14 or 16. The switching units are respectively associated with the keys KEY1 to KEY19, . . . , and depressed keys make the associated switching units close.

The keyboard instrument embodying the present invention further comprises a key assigner 53, and the key assigner 53 periodically scans the switching units of the array 52 to see whether or not a player depresses and releases the keys KEY1 to KEY19, . . . . When the key assigner 53 notices a depressed key, the key assigner 53 produces a key code signal KC indicative of the depressed key and a key-on signal indicative of the closed state of the associated switching unit. On the other hand, if the player releases the key, the key assigner 53 produces the key code signal and a key-off signal indicative of the open-state of the associated switching unit.

The keyboard instrument embodying the present invention further comprises a pair of memory units 54*a* and 54*b* for storing frequency numbers F addressable with the key code signal KC and an accumulator 5 responsive to a sampling clock CK for producing a phase address data signal ADD. The memory units 54*a* and 54*b* are selectively activated by the switching unit SW, and are assigned the twelve note temperament scale and the nineteen note temperament scale, respectively. (12×Octaves) sets of frequency numbers F1 are stored in the memory unit 54*a*, and each set of the frequency numbers is accessible with the key code signal KC. The frequency numbers F1 for a key KEYm and the frequency numbers F1 for another key KEYm+1 are regulated in such a manner that tone signal produced therefrom have a frequency ratio of $\sqrt[12]{2}$. Similarly, (19×Octaves) sets of frequency numbers F2 are memorized in the memory unit 54*b*, and the frequency numbers F2 for a key KEYn ($1 \leqq n < 19$) and the frequency numbers F2 for the key KEYn+1 are regulated in such a manner that tone signals respectively produced therefrom have a frequency ratio of $\sqrt[19]{2}$.

If the key assigner 53 supplies the key code signal KC indicative of the key KEY1, the frequency numbers F1 or F2 corresponding to the pitch name "1" or "C" are sequentially read out from the memory unit 54*a* or 54*b*, and the accumulator 55 accumulates the frequency numbers F1 or F2 read out from the memory unit 54*a* or 54*b* in synchronism with the sampling clock signal CK for producing the phase address data signal ADD. The phase address signal ADD is indicative of a momentary phase of a tone waveform.

The keyboard instrument according to the present invention further comprises a tone generator 56 for producing a tone signal TS and a sound system 57 for producing a sound from the tone signal TS. Though not shown in the drawings, the tone generator 56 has a waveform memory and an envelop generator, and the phase address signal ADD specifies addresses in the waveform memory where amplitude data are stored. The amplitude data are available for forming a single period of a waveform of the tone signal. The emvelop generator is responsive to the key-on signal KON and the key code signal KC for producing the tone signal TS from the amplitude data and emvelop data stored therein. The tone generator 56 is responsive to the key-off signal KOFF so as to terminate the tone signal for the note identified by the key code signal KC.

The sound system 57 covers the tone signal TS to an analog audio signal, and generates a sound with the note specified thorugh the depressed key. In this instance, the switching unit SW, the array 52 of switching units, the key assigner 53, the memory units 54*a* and 54*b*, the accumulator 55, the tone generator 56 and the sound system 57 as a whole constitute an electronic sound generating system.

A player is assumed to select the ninteen note temperament scale, and depresses one of the keys KEYi in a performance. Then, the switching unit assoicated with the key KEYi turns on, and the key assigner 53 supplies the key code signal KC indicative of the key KEYi and the key-on signal KON. The key code signal KC causes the memory 54*b* to supply the key numbers F2 corresponding to the key code KC to the accumulator 55, and the accumulator 55 accumulates the key numbers F2 in synchronism with the sampling clock CK. The accumulator 55 produces the phase address signal ADD from the accumulated value, and the phase address signal ADD sequentially designates the addresses in the waveform memory of the tone generator 56 depending upon the accumulated value. The waveform memory of the tone generator 56 sequentially supplies the amplitude data at respective momentary phases indicated by the phase address signal ADD, and the amplitude data are sequentially multiplied by the emvelop data for producing the tone signal TS. The tone signal TS thus produced is supplied to the sound system 57, and the sound system 57 generates the sound with the note specified by the depressed key KEYi.

The player concurrently depresses the keys assigned the notes of either triad or tetrad listed in FIG. 5B. The sounds concurrently generated by the sound system 57 harmonize with one another. For this reason, the player can create a harmonic progression, and lisners feel the music beautiful.

On the other hand, if the player selects the twelve note temperament scale, the switching unit SW activates the memory unit 54*a* instead of the memory unit 54*a*. In this situation, the key code signal KC causes the memory unit 54*a* to supply a set of frequency numbers F1 to the accumulator 55, and the tone generator 56 tailers the tone signals regulated to the frequency ratio $\sqrt[12]{2}$.

Although particular embodiments of the present invention have been shown and described, it will be obvious to those skilled in the art that various changes and modifications may be made without departing from the spirit and scope of the present invention. The present invention is applicable to any kind of musical instrument which is usually tuned in the twelve notes temperament scale, and an acoustic piano, other wind instruments such as a clarinet and other stringed instrument such as a mandolin are the applicable musical instrument,

What is claimed is:

1. A keyboard musical instrument which allows a player to perform music in one of a twelve note temperament scale and a nineteen note temperament scale, said keyboard musical instrument comprising:

a plurality of keys assigned first notes of the nineteen note temperament scale and second notes of the twelve note temperament scale, and adapted to be selectively depressed by a player for playing music, said plurality of keys being arranged in three rows, two of which are shared between said nineteen note temperament scale and said twelve note temperament scale, said first notes respectively having frequencies forming a geometrical series of $\sqrt[19]{2}$, said second notes respectively having frequencies forming a geometrical series of $\sqrt[12]{2}$; and an electronic sound generating system responsive to the manipulation of said plurality of keys for producing sounds of the notes selected by said player.

2. The keyboard musical instrument as set forth in claim 1, in which a switching means is provided for said three rows so as to selectively enable said three rows.

3. The keyboard musical instrument as set forth in claim 2, in which said electronic sound generating system comprises:

an array of switching units associated with said plurality of keys and shifted between on-state and off-state by the associated keys, a key assigner associated with said array of switching units and operative to detect status of each of said plurality of keys for producing a key code signal indicative of the change in status of a key, a key-on signal indicative of a depressed key and a key-off signal indicative of a released key, a plurality of memory units storing a plurality of sets of first frequency numbers respectively associated with the keys of said two rows for said twelve note temperament scale and a plurality of sets of second frequency numbers respectively associated with said plurality of keys for said nineteen note temperament scale, said plurality of memory units being selectively enabled with said switching means for outputting either first or second frequency numbers, the memory units enabled with said switching means being responsive to said key code signal for sequentially outputting the first or second frequency numbers of the set identified with said key code signal, said plurality sets of first frequency numbers producing respective fundamental frequencies regulated in a geometrical series of $\sqrt[12]{2}$, said plurality sets of second frequency numbers producing respective fundamental frequencies regulated in a geometrical series of $\sqrt[19]{2}$, an accumulator electrically connected with said plurality of memory units and operative to accumulate said first or second frequency numbers output therefrom for producing a phase address signal, a tone generator having a plurality of amplitude data and a plurality of envelop data, and responsive to said phase address signal in the presence of said key-on signal for producing a tone signal, said tone generator terminating the production of said tone signal when said key-off signal is supplied thereto, and a sound system responsive to said tone signal for producing a sound with the note specified by said depressed key.

* * * * *